US005271644A

United States Patent [19]

Merry et al.

[11] Patent Number: 5,271,644

[45] Date of Patent: Dec. 21, 1993

[54] SECURITY DEVICE COMPRISING OPTICALLY VARIABLE DATA AND METHOD FOR MAKING THE SAME

[75] Inventors: Trevor Merry, Nepean; Alan R. Boate, Gloucester, both of Canada

[73] Assignee: Canadian Bank Note Company, Limited, Ottawa, Canada

[21] Appl. No.: 751,986

[22] Filed: Aug. 29, 1991

[51] Int. Cl.[5] ..... B42D 15/00

[52] U.S. Cl. ..... 283/85; 283/57; 283/58; 283/902; 283/904; 359/2

[58] Field of Search ..... 283/85, 902, 904, 57, 283/58; 359/2

[56] References Cited

U.S. PATENT DOCUMENTS

| | | | |
|---|---|---|---|
| 4,434,010 | 2/1984 | Ash | 106/291 |
| 4,510,225 | 4/1985 | Kuehnle | 430/126 |
| 4,547,002 | 10/1985 | Colgate, Jr. | 283/904 |
| 4,597,593 | 7/1986 | Maurer | 283/904 |
| 4,672,891 | 6/1987 | Maurer et al. | 283/904 |
| 5,045,426 | 9/1991 | Maierson | 430/126 |

FOREIGN PATENT DOCUMENTS

| | | | |
|---|---|---|---|
| 944987 | 9/1974 | Canada . | |
| 1253367 | 5/1989 | Canada . | |
| 2015070 | 12/1990 | Canada . | |
| 3921636 | 1/1991 | Fed. Rep. of Germany | 283/902 |
| 3-130194 | 6/1991 | Japan | 283/902 |

OTHER PUBLICATIONS

IBM Technical Disclosure Bulletin, "Secure Document Feature for Copy Machines"; Hobgood, Jr. G. W.; vol. 15 #2 Jul. 1972.

*Primary Examiner*—Paul A. Bell

*Attorney, Agent, or Firm*—Barrigar & Oyen

[57] ABSTRACT

A security-printing device comprising: (i) a substrate; (ii) a toner image adhered to said substrate; and, (iii) a layer of an optically variable material adhered solely to said toner image, whereby said optically variable material is selected to provide a distinct visual appearance and is not readily reproducible or readily available in the general market-place.

2 Claims, 1 Drawing Sheet

SECURITY DEVICE COMPRISING OPTICALLY VARIABLE DATA AND METHOD FOR MAKING THE SAME

FIELD OF THE INVENTION

The invention relates to the field of printed security devices for protecting security documents against unauthorized or fraudulent alteration

BACKGROUND

Many security documents, such as share certificates, cheques and identity documents (e.g. passports), are initially preprinted in skeletal form without individual identifying (variable) data and then later on, when used, the appropriate variable data is printed thereon using a laser printer. Typically, the generation of the variable data, and control of the printer, is by means of a computer.

However, the current widespread usage of laser printing, to apply variable data to security documents, has increased the need for means to protect such data against fraudulent alteration since the toner image used to create a laser-printed image may be fairly readily removed from the document by scraping or dissolving it away. If this is done, substituted (false) data may then be applied to the document to alter the variable data thereon.

One approach for eliminating the foregoing risk of data alteration which is associated with laser-printed documents is to protect the toner image against removal. Many such protective devices have been developed in the market-place, for example, one which applies a laminate patch of transparent material over the area of the document containing the data so that any attempt to alter the data (toner image) would necessarily change the overall appearance of the document.

A second approach for deterring any fraudulent alteration of laser-printed variable data, over that referred to above, has been developed by the inventors herein. Specifically, the inventors have conceived and developed an alternative approach which protects against such alteration by configuring the variable data in such a manner as to enable ready visual detection of any substitute data appearing on a document in place of original variable data. Thus, this means of protection is not intended to physically prevent the removal of a toner image comprising variable data but rather, is directed to enabling one to readily detect if and when any such removal has taken place. If such is detected it may then be concluded that the document comprising the altered data is not authentic and invalid.

SUMMARY OF THE INVENTION

According to the invention there is provided a security printing device comprising a substrate; a toner image adhered to the substrate; and, a layer of an optically variable material adhered solely to the toner image, whereby the optically variable material is selected to provide a distinct visual appearance and is not freely reproducible or freely available in the general marketplace. The optically variable material may be adhered to selected portions of the toner image.

Also in accordance with the invention there is provided a method of making a security printing device comprising a substrate. A toner image is positioned over the substrate. A layer of an optically variable material is positioned over the toner image. Heat and pressure are thereto applied to the substrate, toner image and optically variable material sufficient to cause the optically variable material to adhere solely to the toner image and the toner image to fuse to the substrate.

Preferably the layer of optically variable material is adhered to a continuous tape when it is positioned over the toner.

According to the invention there is also provided another method of making a security-printing device comprising a substrate. A toner image is fused to the substrate. A layer of an optically variable material is positioned over the toner image; Heat and pressure are applied to the substrate, the toner image fused thereto and the layer of an optically variable material, sufficient to cause the toner image to melt and refuse to the substrate and the optically variable material to adhere solely to the toner image.

DESCRIPTION OF THE DRAWINGS

The invention is described in detail under the following heading with reference to FIG. 1 with illustrates a security document comprising variable data.

DETAILED DESCRIPTION OF THE INVENTION

Figure 1:
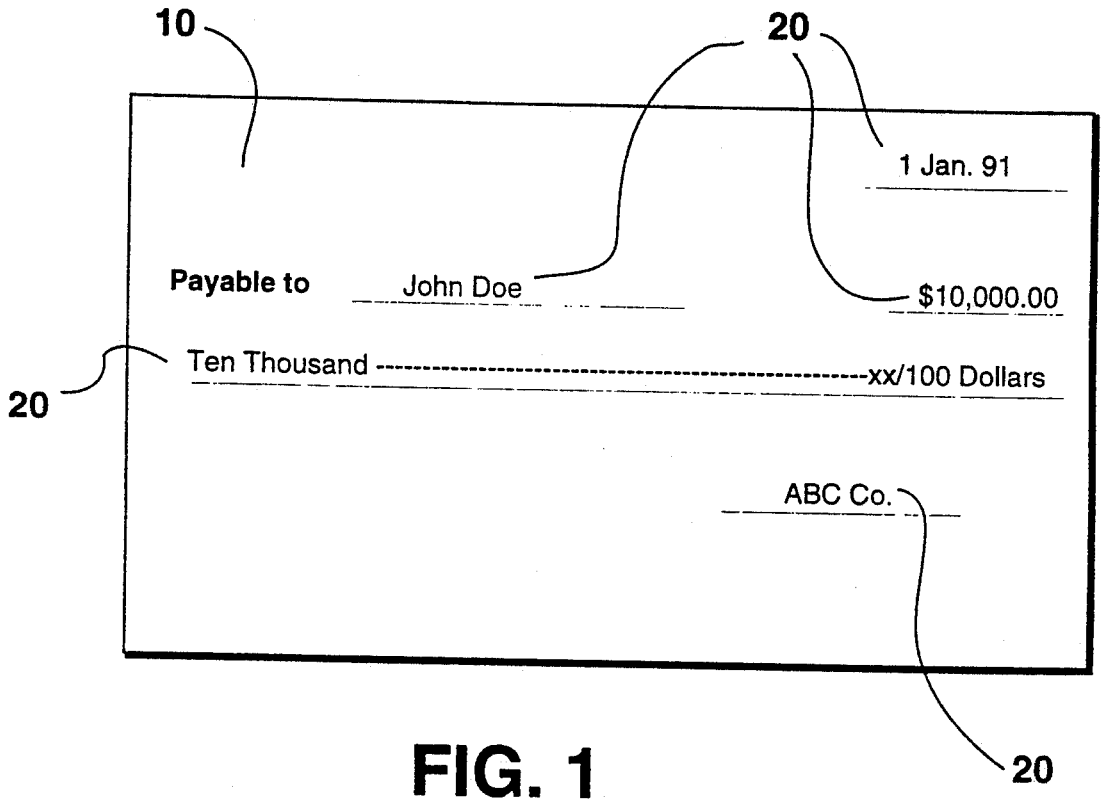

FIG. 1 illustrates an example of a security document contemplated by the invention specifically, a preprinted cheque 10 upon which computer-generated variable data 20 is printed by means of a laser printer which, in accordance with well-known technology, prints data by an electrophotographic process which fuses a toner image of the data to the document (substrate) to be printed.

According to the invention a security device is produced by overlaying the toner image applied by the laser printer with an optically variable material which is, effectively, unreproducible and unavailable in the open marketplace. Suitable optically variable material is known in the security printing industry and, for purposes of the invention, must provide a distinctive visual image when applied to a toner image, must be of a sufficiently complex and secure formulation that it cannot be reproduced by a counterfeiter (at least not within an acceptable degree of probability) and sold only through restricted channels of trade. Examples of such materials are disclosed in Canadian Patent No. 944,987 issued 9 Apr., 1974 to Her Majesty in right of Canada and in U.S. Pat. No. 4,434,010 issued 28 Feb., 1984 and Canadian Patent No. 1,253,367 issued 2 May, 1989 granted to Optical Coating Laboratory, Inc. In each case the materials disclosed in these references is made of thin film layers having preselected optical properties. A further example is the material disclosed in Published Canadian Patent Application No. 2,015,750, published 5 Dec., 1990, in the name of Landis & Gyr Betriebs AG which is made from optical diffraction elements. When viewed at different angles, a variety of effects can be realized by these materials such as color shifts, reflectivity differences or multiple images.

A suitable optical coating material, being one which is used by the inventors, is available from Identicard Ltd. of Ontario (Canada) to a restricted class of purchasers operating in the security printing industry. This material is in the form of a thin film adhered to a narrow tape.

An optical coating material according to the foregoing may be applied to a laser-printed toner image by a number of methods resulting in a fusing of a layer of the material to the top of the toner image. The optical coating may, preferably, take the form of a layer adhered to a continuous tape but, alternatively, may be a powder. A discussion of three examples of methods of applying an optical material to a toner image, in accordance with the invention, is provided in the following.

(i) Tape Transfer Method

The tape transfer method developed by the inventors, applied to laser printing, utilizes an optically variable thin film material in the form of a narrow tape (as acquired from Identicard Ltd.). This material consists of thin film interference layers of oxides of Zirconium and Aluminium vacuum deposited on a mylar carrier. A release layer on the carrier permits removal of the thin film to its final substrate (i.e. the toner image fused to the security document).

The foregoing thin film material is looped through the fusing rollers of a laser printer (e.g. a Hewlett Packard HP III Laser Printer) so that the surface of the thin film comes into contact with the substrate (i.e. the document) to which variable data is being printed by the printer and is ejected from the printer in contact with the toner image. When the printer receives the variable data image to be printed, the image is then formed on the photoconductive receptor of the printer and toner powder is attracted to the imaged areas. The toner image is then transferred to the document and fused to the document by heat and pressure. Since the optical thin film is applied over the toner image at this time, by the fusing rollers, the thin film material is caused to adhere to the toner image. The mylar carrier, carrying the optical material, is then pulled away from the document so that only the layer of optically variable material which is adhered to the toner image (i.e. the variable data printed on the document) remains on the document. The methods herein thereby advantageously, effectively, transform the conventional toner image to an optically variable image.

(ii) Powder Transfer Method

The powder transfer method developed by the inventors, applied to a toner image, uses an optically variable material in powder form. For this method the paper sheet to which the toner image is to be applied is removed before the toner is fused. The optically variable powder is then placed over the unfused toner and the paper is heated under pressure to 145° C. The toner image and powder thereover are thereby fused and melted together and the image is fused to the paper. The excess powder is then brushed away so as to leave only the layer of the optically variable material which has adhered to the toner image.

(iii) Post-Transfer Method

The post-transfer method developed by the inventors, applied to a toner image, uses optically variable tape according to that used in the first above-described method. By this method, the toner image is fused to the paper. Then, an optically variable tape is placed over the toner image and heated under pressure to 145° C. The toner image is thereby caused to remelt and adhere to the optically variable layer. The tape is then removed from the image so as to leave only the layer of the optically variable material which has adhered to the toner image.

In respect of any of the foregoing methods, the optically variable material may be applied to selected portions of the toner image rather than to the whole of the toner image of the variable data.

What is claimed is:

1. A protected security document comprising:
(i) a substrate with preprinted indicia thereon;
(ii) variable indicia comprising a toner image adhered to said substrate; and
(iii) a layer of an optically variable material solely adhered to said toner image, whereby said optically variable material is selected to provide a distinct visual appearance and is not readily reproducible or readily available in the general marketplace.

2. A protected security document according to claim 1 wherein said optically variable material is adhered to selected portions of said toner image.

* * * * *